US007806734B1

(12) United States Patent
Yu

(10) Patent No.: US 7,806,734 B1
(45) Date of Patent: Oct. 5, 2010

(54) AUDIO JACK CONNECTOR

(75) Inventor: Sheng-Nan Yu, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/760,290

(22) Filed: Apr. 14, 2010

(51) Int. Cl.
*H01R 24/04* (2006.01)

(52) U.S. Cl. ..... 439/668

(58) Field of Classification Search ..... 439/668, 439/669

See application file for complete search history.

(56) References Cited

U.S. PATENT DOCUMENTS 6,551,127 B1 * 4/2003 Li et al. ..... 439/668
6,676,451 B2 * 1/2004 Suzuki et al. ..... 439/668
7,645,170 B2 * 1/2010 Long et al. ..... 439/668
2009/0149081 A1 * 6/2009 Zhu et al. ..... 439/668

* cited by examiner

*Primary Examiner*—Tho D Ta
(74) *Attorney, Agent, or Firm*—WPAT, Inc.; Anthony King

(57) ABSTRACT

An audio jack connector includes an insulating housing, a movable terminal, a fixed terminal, and a conductive ring. The insulating housing has a main body and a cylindrical sleeve, and defines an insertion hole therein for receiving an audio plug. A bottom of the insulating housing defines an opening across a junction of the main body and the sleeve and communicating with the insertion hole. The movable terminal has an elastic arm projected into the insertion hole from the opening. The fixed terminal has a contact arm attached to an outer periphery of the sleeve. The conductive ring encircles the sleeve with the contact arm against an inner side thereof. The movable terminal is electrically connected with the fixed terminal through the conductive ring when the audio plug is inserted into the insertion hole to push the elastic arm up to contact with the inner side of the conductive ring.

10 Claims, 3 Drawing Sheets

AUDIO JACK CONNECTOR

BACKGROUND OF THE INVENTION

1. Field of the Invention

The present invention relates to an audio jack connector, and more particularly to an audio jack connector capable of currently detecting insertion of an audio plug.

2. The Related Art

Audio jack connectors are widely used in kinds of electronic equipments, such as MP3/MP4, mobile phones, computers and other equipments for transmitting sound signals. A conventional audio jack connector includes an insulating housing and a switch terminal unit received in the insulating housing. The switch terminal unit includes a fixed terminal and a movable terminal. The movable terminal has a flat first contact portion. The fixed terminal has a flat second contact portion pressed under the first contact portion of the movable terminal. When an audio plug is inserted into the audio jack connector, the first contact portion of the movable terminal will be pushed away by the audio plug to disconnect with the second contact portion of the fixed terminal. When the audio plug is drawn out from the audio jack connector, the first contact portion of the movable terminal restores to press against and electrically connect with the second contact portion of the fixed terminal again.

However, because the first contact portion and the second contact portion are flat, the contact between the first contact portion and the second contact portion may be unstable or even disconnected if they are oxidized or stuck with external objects (eg., dust or greasiness) on the surfaces thereof. Thereby, the switch terminal unit will not currently detect whether the audio plug is inserted or not.

SUMMARY OF THE INVENTION

It is an object of the present invention to provide an audio jack connector capable of currently detecting insertion of an audio plug. The audio jack connector adapted for receiving an audio plug includes an insulating housing, a movable terminal, a fixed terminal, and a conductive ring. The insulating housing has a main body and a cylindrical sleeve integrally formed at a front of the main body. The insulating housing defines an insertion hole penetrating through the sleeve and extending into an inside of the main body for receiving the audio plug. A bottom of the insulating housing defines an opening across a junction of the main body and the sleeve and communicating with the insertion hole. The movable terminal is received in the insulating housing, having an elastic arm disposed in the opening with a portion thereof projected into the insertion hole. The fixed terminal is received in the insulating housing and apart from the movable terminal, having a contact arm attached to an outer periphery of the sleeve. The conductive ring encircles the sleeve of the insulating housing with the contact arm of the fixed terminal against an inner side thereof. The movable terminal is electrically connected with the fixed terminal through the conductive ring when the audio plug is inserted into the insertion hole to push the elastic arm up to contact with the inner side of the conductive ring.

As described above, when the audio plug is inserted into the audio jack connector, the elastic arm is pushed up to contact with the inner side of the conductive ring, then the movable terminal is electrically connected with the fixed terminal through the conductive ring to detect the insertion of the audio plug.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
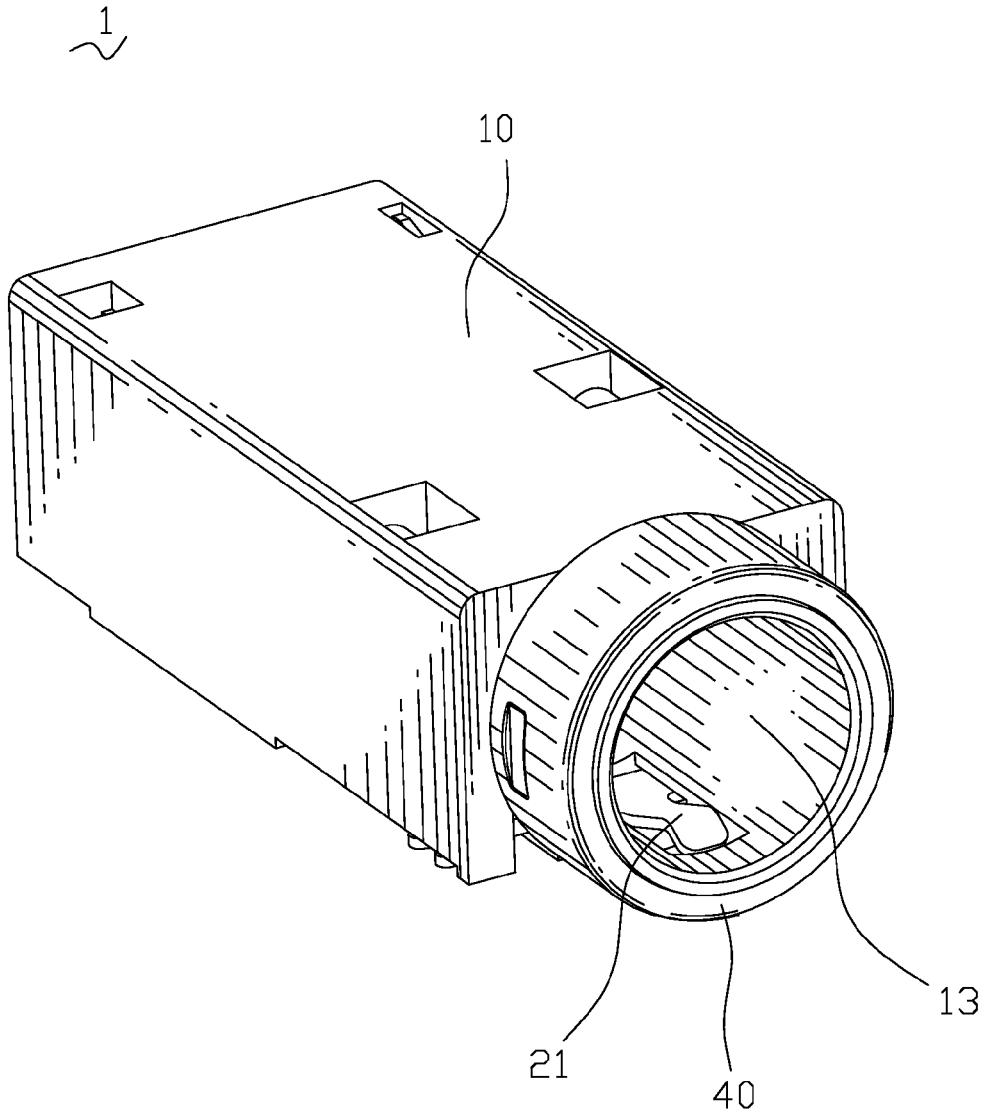
FIG. 1 is a perspective view of an audio jack connector in accordance with the present invention.
Figure 2:
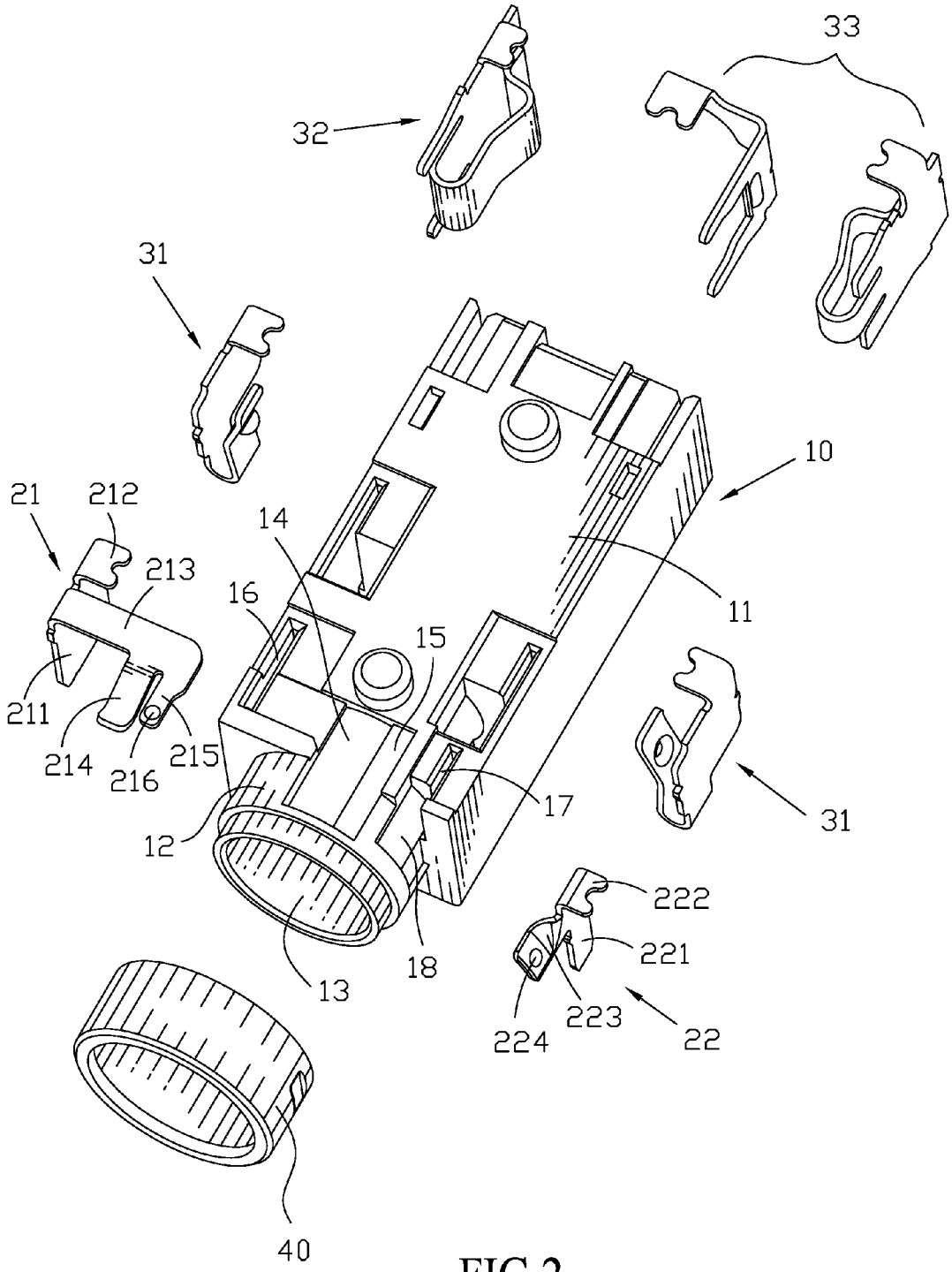
FIG. 2 is an exploded view of the audio jack connector shown in FIG. 1.

With reference to FIGS. 1 and 2, an audio jack connector 1 according to the present invention is shown. The audio jack connector 1 includes an insulating housing 10, a plurality of terminals received in the insulating housing 10 and a conductive ring 40. The terminals include a first switch terminal unit, a pair of first signal terminals 31, a second signal terminal 32, and a second switch terminal unit 33.

The insulating housing 10 has a main body 11 showing rectangular parallelepiped shape and a cylindrical sleeve 12 integrally formed at a front of the main body 11. The insulating housing 10 defines an insertion hole 13 extended along a front and rear direction to penetrate through the cylindrical sleeve 12 and the main body 11 for receiving an audio plug 2 (see FIG. 4) and a plurality of terminal grooves at a bottom thereof for correspondingly receiving the terminals.

The terminal grooves include an opening 14, a trough 15, a fixing slot 16, a fixing slit 17 and a notch 18. The opening 14 and the trough 15 are defined at a bottom of the insulating housing 10 and extend longitudinally to across a junction of the main body 11 and the cylindrical sleeve 12. An inner side of the opening 14 is connected with an inner side of the trough 15. The opening 14 further penetrates through the bottom of the insulating housing 10 to communicate with the insertion hole 13. The fixing slot 16 and the fixing slit 17 are respectively defined at two opposite sides of a bottom of the main body 11. In this embodiment, the fixing slot 16 is arranged outside the opening 14 while the fixing slit 17 is arranged outside the trough 15. The notch 18 is defined at an outer periphery of the cylindrical sleeve 12 and communicated with the fixing slit 17.

The first switch terminal unit includes a movable terminal 21 and a fixed terminal 22. The movable terminal 21 has a bottom plate 213 and a fixed plate 211 extended upward from an end of the bottom plate 213 and further extended rearward to exceed the bottom plate 213. A rear portion of a bottom edge of the fixed plate 211 extends parallel to the bottom plate 213 to form a soldered plate 212. A free end of the bottom plate 213 extends frontward to form an elastic arm 214 having an arched distal end and an extending arm 215 adjacent to an outside of the elastic arm 214. A contact protrusion 216 is punched at a distal end of the extending arm 215.

The fixed terminal 22 has a fixed base 221 and a soldered portion 222 extended sideward from a bottom edge of the fixed base 221. A contact arm 223 extends frontward from a lower portion of a front edge of the fixed base 221 and twists to match up the outer periphery of the cylindrical sleeve 12. A contact projection 224 is punched at a distal end of the contact arm 223. The pair of the first signal terminals 31, the second signal terminal 32 and the second switch terminal unit 33 are not described in detail herein because they are known to one having ordinary skill in the art.

In assembly, the fixed plate 211 of the movable terminal 21 is inserted into the fixing slot 16 to mount the movable terminal 21 to the insulating housing 10. The soldered plate 212 and the bottom plate 213 are attached to the bottom of the insulating housing 10. The elastic arm 214 is disposed in the opening 14 with the arched distal end thereof projected into the insertion hole 13. The extending arm 215 is located in the trough 15. The fixed base 221 of the fixed terminal 22 is inserted into the fixing slit 17 to mount the fixed terminal 22 to the insulating housing 10. The soldered portion 222 is attached to the bottom of the insulating housing 10. The contact arm 223 is received in the notch 18. The conductive ring 40 is assembled to encircle the cylindrical sleeve 12 with the contact projection 224 of the fixed terminal 22 against an inner side of the cylindrical sleeve 12.

Figure 3:
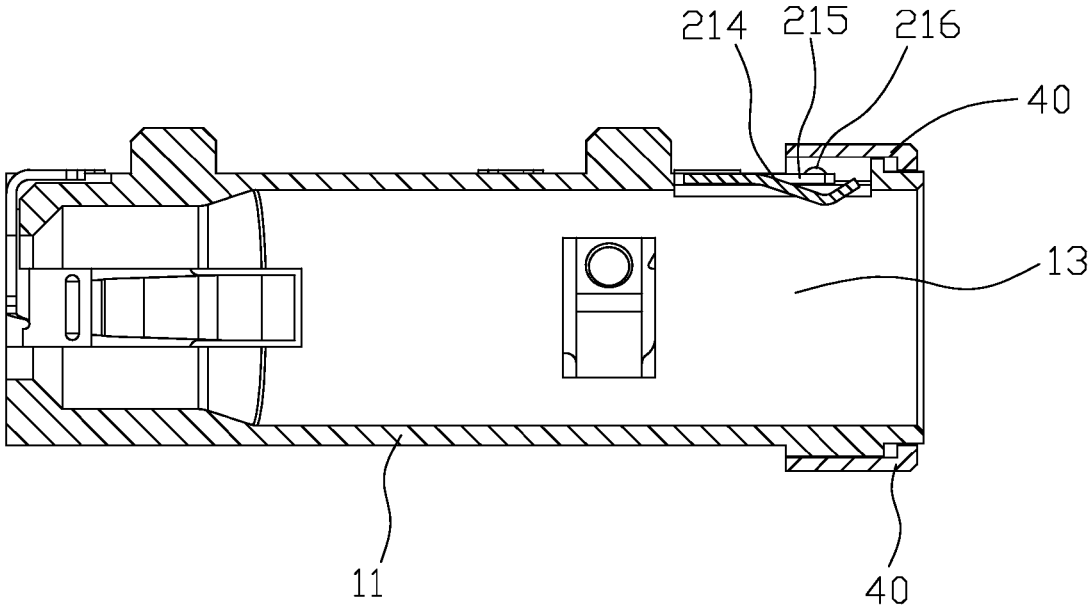
FIG. 3 is a cross-sectional view of the audio jack connector shown in FIG. 1.
Figure 4:
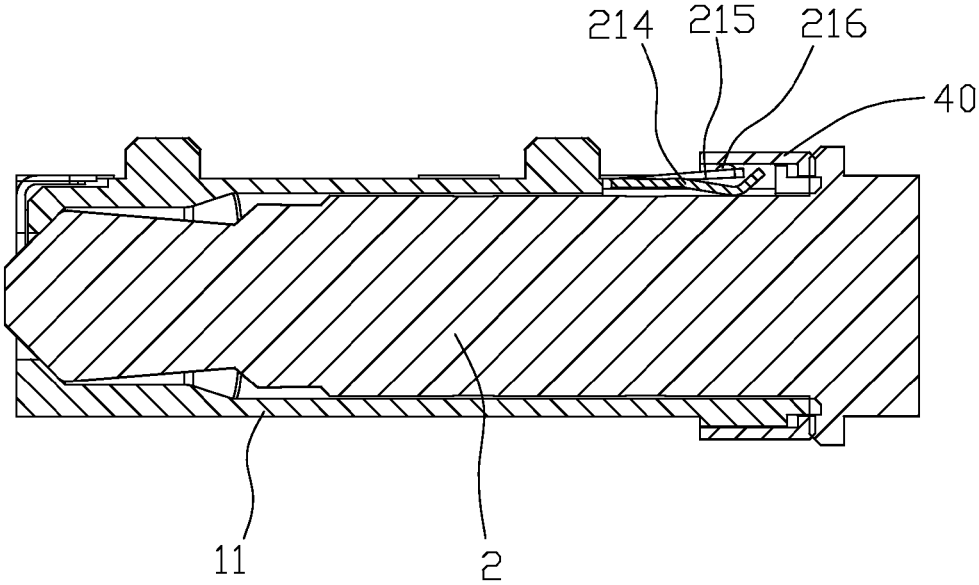
FIG. 4 is a cross-sectional view of the audio jack connector when an audio plug is inserted thereinto.

With reference to FIGS. 3 and 4, before the audio plug 2 is inserted into the audio jack connector 1, the elastic arm 214 and the contact protrusion 216 do not contact with the conductive ring 40. When the audio plug 2 is inserted into the insertion hole 13, the audio plug 2 pushes the elastic arm 214 up to contact with the inner side of the cylindrical sleeve 12. At the same time, the extending arm 215 is driven up to make the contact protrusion 215 contact with the inner side of the cylindrical sleeve 12 too. Then the movable terminal 21 is electrically connected with the fixed terminal 22 through the conductive ring 40 to detect the audio plug 2 has been inserted into the audio jack connector 1.

As described above, when the audio plug 2 is inserted into the audio jack connector 1, the elastic arm 214 is pushed up to contact with the inner side of the conductive ring 40, then the movable terminal 21 is electrically connected with the fixed terminal 22 through the conductive ring 40 to detect insertion of the audio plug 2. Furthermore, the extending arm 215 is driven up to make the contact protrusion 216 contact with the inner side of the conductive ring 40 when the audio plug 2 pushes up the elastic arm 214, which ensures the connection between the movable terminal 21 and the conductive ring 40 double and more stable. Therefore, the electrical connection between the movable terminal 21 and the fixed terminal 22 is more stable, which helps to detect the insertion of the audio plug 2 more correctly.

What is claimed is:

1. An audio jack connector for receiving an audio plug, comprising:

an insulating housing having a main body and a cylindrical sleeve integrally formed at a front of the main body, the insulating housing defining an insertion hole penetrating through the sleeve and extending into an inside of the main body for receiving the audio plug, a bottom of the insulating housing defining an opening across a junction of the main body and the sleeve and communicating with the insertion hole;

a movable terminal received in insulating housing, the movable terminal having an elastic arm disposed in the opening with a portion thereof projected into the insertion hole;

a fixed terminal received in the insulating housing and apart from the movable terminal, the fixed terminal having a contact arm attached to an outer periphery of the sleeve; and a conductive ring encircling the sleeve of the insulating housing with the contact arm of the fixed terminal against an inner side thereof, wherein the movable terminal is electrically connected with the fixed terminal through the conductive ring when the audio plug is inserted into the insertion hole to push the elastic arm up to contact with the inner side of the conductive ring.

2. The audio jack connector as claimed in claim 1, wherein the bottom of the insulating housing defines a trough across the junction of the main body and the sleeve, an inner side of the opening is connected with an inner side of the trough, the movable terminal further has an extending arm located in the trough, the extending arm is driven up to contact with the inner side of the conductive ring when the audio plug pushes up the elastic arm.

3. The audio jack connector as claimed in claim 2, wherein the movable terminal has a bottom plate attached to the bottom of the insulating housing, the elastic arm and the extending arm are extended frontward from a free end of the bottom plate, the extending arm is adjacent to an outside of the elastic arm.

4. The audio jack connector as claimed in claim 2, wherein the extending arm of the movable terminal has a contact protrusion at the distal end thereof to be against the inner side of the conductive ring.

5. The audio jack connector as claimed in claim 1, wherein the movable terminal has a bottom plate attached to the bottom of the insulating housing, the elastic arm is extended frontward from a free end of the bottom plate.

6. The audio jack connector as claimed in claim 5, wherein the bottom of the insulating housing defines a fixing slot at a side of the main body, the movable terminal has a fixed plate extended upward from an end of the bottom plate opposite to the elastic arm and further extended rearward to exceed the bottom plate to be inserted into the fixing slot.

7. The audio jack connector as claimed in claim 6, wherein a rear portion of a bottom edge of the fixed plate extends parallel to the bottom plate to form a soldered plate attached to the bottom of the insulating housing.

8. The audio jack connector as claimed in claim 1, wherein the bottom of the insulating housing defines a fixing slit at a side of the main body, the sleeve defines a notch at the outer periphery thereof to communicate with the fixing slit, the fixed terminal has a fixed base inserted into the fixing slit, the contact arm extends frontward from a lower portion of a front edge of the fixed base to be received in the notch and twists to match up the outer periphery of the sleeve.

9. The audio jack connector as claimed in claim 8, wherein the contact arm of the fixed terminal has a contact projection thereon to be against the inner side of the conductive ring.

10. The audio jack connector as claimed in claim 8, wherein a bottom of the fixed base extends sideward to form a soldered portion attached to the bottom of the insulating housing.

* * * * *